US012569069B2

(12) United States Patent
Andersson

(10) Patent No.: US 12,569,069 B2
(45) Date of Patent: Mar. 10, 2026

(54) FURNITURE, CONVERTIBLE FROM A SOFA TO A BED

(71) Applicant: Inter IKEA Systems B.V., Ln Delft (NL)

(72) Inventor: Benny Andersson, Älmhult (SE)

(73) Assignee: Inter IKEA Systems B.V., LN Delft (NL)

( * ) Notice: Subject to any disclaimer, the term of this patent is extended or adjusted under 35 U.S.C. 154(b) by 76 days.

(21) Appl. No.: 18/549,630

(22) PCT Filed: Mar. 10, 2022

(86) PCT No.: PCT/SE2022/050240
§ 371 (c)(1),
(2) Date: Sep. 8, 2023

(87) PCT Pub. No.: WO2022/191764
PCT Pub. Date: Sep. 15, 2022

(65) Prior Publication Data

US 2024/0148151 A1 May 9, 2024

(30) Foreign Application Priority Data

Mar. 11, 2021 (SE) ..... 2150282-8

(51) Int. Cl.
*A47C 17/23* (2006.01)
*A47C 17/02* (2006.01)
(Continued)

(52) U.S. Cl.
CPC ..... *A47C 17/23* (2013.01); *A47C 17/02* (2013.01); *A47C 17/04* (2013.01); *A47C 17/13* (2013.01); *A47C 17/134* (2013.01); *A47C 17/136* (2013.01)

(58) Field of Classification Search
CPC ..... A47C 17/138; A47C 17/37; A47C 17/26; A47C 17/23; A47C 17/04; A47C 17/136;
(Continued)

(56) References Cited

U.S. PATENT DOCUMENTS 1,119,563 A 12/1914 Arton
1,464,900 A 8/1923 Brainerd
(Continued)

FOREIGN PATENT DOCUMENTS

AT 167149 B 11/1950
DE 53456 C 9/1890
(Continued)

*Primary Examiner* — David R Hare
*Assistant Examiner* — Deborah Talitha Gedeon
(74) *Attorney, Agent, or Firm* — Capitol City TechLaw

(57) ABSTRACT

A furniture may include a frame structure and a seat cushion arrangement. The frame structure may include an elongated platform. The seat cushion arrangement may be supported by the platform in a first operative state in which at least a substantial portion of an elongated upper surface of the seat cushion arrangement is inclined in relation to a horizontal plane (HP) for establishing an elongated sitting area for a plurality of users. The seat cushion arrangement may be supported by the platform in a second operative state in which a substantial portion of an upper surface of the seat cushion arrangement is in parallel with the horizontal plane for establishing an elongated lying area for at least one user, wherein the lying area has a direction between a head end and a foot end in parallel with a longitudinal direction of the platform.

16 Claims, 3 Drawing Sheets

(51) Int. Cl.
*A47C 17/04* (2006.01)
*A47C 17/13* (2006.01)

(58) Field of Classification Search
CPC ..... A47C 17/13; A47C 17/165; A47C 17/17; A47C 17/207; A47C 20/041; A47C 20/08; A47C 31/008; A47C 7/021; A47C 1/02; A47C 1/032; A47C 15/004; A47C 17/045; A47C 17/16; A47C 17/1655; A47C 17/162; A47C 20/02; A47C 3/16; A47C 7/024; A47C 5/125
USPC ..... 297/108
See application file for complete search history.

(56) References Cited

U.S. PATENT DOCUMENTS

| | | | | |
|---|---|---|---|---|
| 2016/0176315 | A1* | 6/2016 | Moore | B60N 2/58 297/108 |
| 2020/0069063 | A1* | 3/2020 | Bates | A47C 15/004 |
| 2022/0160130 | A1* | 5/2022 | Works | A47C 7/66 |

FOREIGN PATENT DOCUMENTS

| | | | | |
|---|---|---|---|---|
| DE | 174910 | C | 8/1906 | |
| DE | 8101291 | U1 | 7/1981 | |
| DE | 202010005285 | U1 * | 4/2011 | A47C 17/13 |
| GB | 475628 | A | 11/1937 | |
| GB | 871365 | A | 6/1961 | |
| KR | 100846930 | B1 * | 7/2008 | |
| NO | 179122 | B | 5/1996 | |

* cited by examiner

FURNITURE, CONVERTIBLE FROM A SOFA TO A BED

This application claims priority under 35 USC 119(a)-(d) from SE patent application No. 2150282-8 filed on Mar. 11, 2021, the entire contents of which are incorporated herein by reference.

TECHNICAL FIELD

The invention relates to a furniture comprising a frame structure and a seat cushion arrangement, wherein the frame structure comprises an elongated platform, wherein the platform and the seat cushion arrangement are adapted so that the seat cushion arrangement may be supported by the platform in a first operative state in which at least a substantial portion of an elongated upper surface of the seat cushion arrangement adjacent a first longitudinally extending lateral end of the elongated platform is inclined in relation to a horizontal plane towards the first longitudinally extending lateral end of the elongated platform for establishing an elongated sitting area for a plurality of users.

Such a furniture may be formed by a sofa. The upper surface of the seat cushion arrangement extends backwards towards a back rest and its inclination downwards provides for a comfortable sitting body posture. However, sleeping in a sofa with such an inclination of the upper surface of the seat cushion arrangement may not be optimal since the body tends to roll towards the backrest.

Further, it is known with a furniture that may function as a bed in addition to a sofa. It is normally called a sofa bed. One type of sofa bed comprises an extendable support construction arranged under the seat cushion arrangement. When the sofa bed is to be converted from a sofa to a bed, the seat cushion arrangement is removed and the extendable support construction is extended in a direction away from the backrest so that a lying area is achieved with a direction between a head end and a foot end perpendicular to a longitudinal direction of the backrest. A mattress may then be placed on top of the extended support construction.

SUMMARY

One object of the invention is to provide a furniture that may be converted from a sofa to a bed in an easy way, which is cost-effective in production and creates conditions for a comfortable sleeping body posture.

The object is achieved by a furniture according to claim 1. Thus, it is achieved by a furniture comprising a frame structure and a seat cushion arrangement, wherein the frame structure comprises an elongated platform, wherein the platform and the seat cushion arrangement are adapted so that the seat cushion arrangement may be supported by the platform in a first operative state in which at least a substantial portion of an elongated upper surface of the seat cushion arrangement adjacent a first longitudinally extending lateral end of the elongated platform is inclined in relation to a horizontal plane towards the first longitudinally extending lateral end of the elongated platform for establishing an elongated sitting area for a plurality of users, characterized in that the seat cushion arrangement is adapted to be supported by the platform in a second operative state in which a substantial portion of an upper surface of the seat cushion arrangement is in parallel with the horizontal plane for establishing an elongated lying area for at least one user, wherein the lying area has a direction between a head end and a foot end in parallel with a longitudinal direction of the platform.

According to one example, the elongated platform and the seat cushion arrangement are designed in relation to each other in such a way that the seat cushion arrangement may be arranged in different orientations on top of the platform for providing the first operative state for one or several users sitting on the seat cushion arrangement and the second operative state for one or several users lying (sleeping) on the seat cushion arrangement.

According to one example, the frame structure is designed so that the elongated platform is arranged at a vertical distance from a support surface (floor), on which the furniture is located. Further, the frame structure may be provided with a plurality of legs, which are adapted to contact the support surface and position the platform at the vertical distance from the support surface.

According to one example, the platform has two laterally extending ends defining the platform in the longitudinal direction and two longitudinally extending ends defining the platform in a lateral direction. According to one example, each one of the two laterally extending ends extends along a straight line and the two laterally extending ends are in parallel with each other. Likewise, each one of the two longitudinally extending ends extends along a straight line and the longitudinally extending ends are in parallel with each other. According to a further example, the laterally extending ends are directed perpendicularly in relation to the longitudinally extending ends. Thus, the platform may have a rectangular shape.

According to a further example, the platform comprises a front beam and a rear beam arranged in parallel with and spaced from each other defining two longitudinally extending ends of the platform. Further, the front beam may be arranged at a higher position than the rear beam in a vertical direction of the frame structure so that the platform is inclined rearwards downwards.

In addition, the platform may comprise a right beam and a left beam arranged in parallel with and spaced from each other defining two laterally extending ends of the platform. The front beam, rear beam, right beam and a left beam may form a rectangular frame section.

According to one example, the seat cushion arrangement has a width and a depth, wherein it is adapted to be arranged on the platform in an orientation such that the width is in parallel with the longitudinal direction of the elongated platform and the depth is in parallel with a lateral direction of the elongated platform.

According to one example, the substantial portion of the upper surface of the seat cushion arrangement adjacent the lateral side edge of the elongated platform, which is inclined in relation to the horizontal plane in the first operative state extends along substantially the complete extension of the seat cushion arrangement in the width direction of the seat cushion arrangement. Further, the substantial portion of the upper surface of the seat cushion arrangement adjacent the lateral side edge of the elongated platform, which is inclined in relation to the horizontal plane in the first operative state may have an extension of at least half a lateral extension of the elongated platform perpendicular to the longitudinal direction.

The seat cushion arrangement comprises at least one seat cushion part. According to one example, each one of the at least one seat cushion part has an extension in a depth direction substantially corresponding to a lateral extension of the platform, thereby forming a substantially continuous cushion layer in the lateral direction of the platform. According to one example, the seat cushion arrangement comprises a single cushion part. According to an alternative example, the seat cushion arrangement comprises a plurality of seat cushion parts, which may be arranged next to one another in the longitudinal direction of the platform, thereby forming a substantially continuous cushion layer in the longitudinal direction of the platform. Thus, the seat cushion arrangement may be adapted to cover the complete platform in the longitudinal direction and in the lateral direction perpendicular to the longitudinal direction. In other words, the seat cushion arrangement may have a substantially rectangular shape matching the rectangular shape and dimension of the platform.

As stated, in the first operative state, the seat cushion arrangement is adapted so that a substantial portion of an upper surface of the seat cushion arrangement adjacent a first longitudinally extending lateral end of the elongated platform is inclined in relation to a horizontal plane towards the first longitudinally extending lateral end of the elongated platform. This design creates conditions for a comfortable sitting position in that the upper part of the legs of a user may be inclined correspondingly in relation to the horizontal plane towards the first longitudinally extending lateral end of the elongated platform. Further, the furniture may be provided with a backrest adjacent the first longitudinally extending lateral end of the elongated platform. Further, the backrest may be designed so that a user contact surface of the backrest is inclined relative to a vertical plane away from the platform. This design creates further conditions for a comfortable sitting position in that the user may have a body posture such that his/her back may be inclined correspondingly in relation to the vertical plane.

In the first operative state, users may be sitting on the seat cushion arrangement with body postures extending transverse relative to the longitudinal direction of the platform and next to one another in the longitudinal direction of the platform.

According to one example, the first main surface of the seat cushion arrangement has a shape bulging outwards. According to one example, in the first operative state, the seat cushion arrangement is arranged so that the bulging surface forms the upper surface of the seat cushion arrangement. Depending on the curvature of the convex shape and the orientation of the seat cushion arrangement on the platform, a portion of the upper surface of the seat cushion arrangement adjacent a second longitudinally extending lateral end of the elongated platform may be substantially flat or somewhat inclined in relation to a horizontal plane towards the second longitudinally extending lateral end of the elongated platform.

According to one embodiment, the elongated platform and the seat cushion arrangement are adapted so that a straight line between a first end of the upper surface of the seat cushion arrangement adjacent the first longitudinally extending lateral end of the elongated platform and a second end of the upper surface of the seat cushion arrangement adjacent a second longitudinally extending lateral end of the elongated platform has an angle in the interval of 1°-30° relative to a horizontal plane when the seat cushion arrangement is arranged in the first operative state. Such an arrangement creates conditions for a comfortable sitting body posture.

According to a further embodiment, the elongated platform and the seat cushion arrangement are adapted so that a straight line between a first end of the upper surface of the seat cushion arrangement adjacent the first longitudinally extending lateral end of the elongated platform and a second end of the upper surface of the seat cushion arrangement adjacent a second longitudinally extending lateral end of the elongated platform has an angle in the interval of 2°-15° relative to a horizontal plane when the seat cushion arrangement is arranged in the first operative state. Such an arrangement creates further conditions for a comfortable sitting body posture.

According to a further embodiment, the seat cushion arrangement comprises a first main surface and a second main surface on an opposite side of the seat cushion arrangement relative to the first main surface, and wherein the seat cushion arrangement is adapted to be arranged on the platform so that the first main surface forms the upper surface of the seat cushion arrangement in the first operative state and so that the second main surface forms the upper surface of the seat cushion arrangement in the second operative state.

According to one example, the seat cushion arrangement comprises a single cushion extending throughout the seat cushion arrangement in a height direction of the seat cushion arrangement. In other words, the seat cushion arrangement comprises a single cushion defining the first main surface on one side and the second main surface on the other side. The cushion may comprise a cushion filling and a fabric forming a pocket for receiving and enveloping the cushion filling. Further, the cushion filling may be provided inside the fabric pocket in a way distancing opposite fabric portions, which define the first main surface and the second main surface.

In other words, the first main surface is intended for facing upwards in the first operative state and may consequently be termed a sitting surface. Likewise, the second main surface is intended for facing upwards in the second operative state and may consequently be termed a lying/sleeping surface.

According to one example, the platform defines an upper rectangular continuous support surface. In the example that the seat cushion arrangement comprises a single cushion defining the first main surface on one side and the second main surface on the other side, the single cushion would be oriented so that the second main surface would face the upper rectangular continuous support surface of the platform when the seat cushion arrangement is supported by the platform in the first operative state (for sitting). More specifically, the second main surface would contact and rest on the upper rectangular continuous support surface of the platform when the seat cushion arrangement is supported by the platform in the first operative state. Similarly, the single cushion would be oriented so that the first main surface would face the upper rectangular continuous support surface of the platform when the seat cushion arrangement is supported by the platform in the second operative state (for lying/sleeping). More specifically, the first main surface would contact and rest on the upper rectangular continuous support surface of the platform when the seat cushion arrangement is supported by the platform in the second operative state.

According to one example, the platform defines an upper rectangular surface extending at an angle in relation to a horizontal plane.

According to a further embodiment, the first main surface has a convex shape and the second main surface is substantially flat when the seat cushion arrangement rests on the second main surface. Especially, the first main surface has a convex shape and the second main surface is substantially flat when the seat cushion arrangement is in a non-stressed state. The expression "non-stressed state" means a situation when the seat cushion arrangement is not subjected to any loading.

According to a further embodiment, the seat cushion arrangement comprises a first main surface and a second main surface on an opposite side of the seat cushion arrangement relative to the first main surface, wherein the first main surface and the second main surface at least partly converge in a direction from a second longitudinally extending lateral end of the seat cushion arrangement towards a first longitudinally extending lateral end of the seat cushion arrangement. In other words, the seat cushion arrangement may be generally wedge-shaped in cross section.

According to one example, such a generally wedge-shaped seat cushion arrangement is combined with a frame structure comprising a rearwardly downwards inclined elongated platform for supporting the seat cushion arrangement, wherein the wedge-shape of the seat cushion arrangement and the inclination of the platform are adapted to each other such that the upper surface of the seat cushion arrangement is inclined rearwards in relation to a horizontal plane for establishing a comfortable elongated sitting area when the seat cushion arrangement is supported by the platform in the first operative state and that the upper surface of the seat cushion arrangement is in parallel with the horizontal plane for establishing a comfortable elongated lying/sleeping area when the seat cushion arrangement is supported by the platform in the second operative state. In other words, the wedge-shape of the seat cushion arrangement is matched to the inclination of the platform so that the inclination of the platform is levelled out to provide a horizontal upper surface by the cushion arrangement in the second operative state.

According to a further development of the last-mentioned embodiment, the seat cushion arrangement comprises a first longitudinally extending lateral edge surface, which connects the first main surface and the second main surface, and a second longitudinally extending lateral edge surface, which connects the first main surface and the second main surface on an opposite side of the seat cushion arrangement relative to the first longitudinally extending lateral edge surface, wherein the second longitudinally extending lateral edge surface has a larger extension in a direction between the first main surface and the second main surface than the first longitudinally extending lateral edge surface so that the first main surface and the second main surface at least partly converge in a direction from the second lateral edge surface towards the first lateral edge surface.

According to a further development of the last-mentioned embodiment, the cushion arrangement is designed so that a straight line extending between a first end of the first longitudinally extending lateral edge surface at the first main surface of the cushion arrangement and a first end of the second longitudinally extending lateral edge surface at the first main surface of the cushion arrangement has an angle in the interval of 1°-20° relative to a straight line extending between a second end of the first longitudinally extending lateral edge surface at the second main side of the cushion arrangement and a second end of the second longitudinally extending lateral edge surface at the second main side of the cushion arrangement.

According to an alternative to the further development of the last-mentioned embodiment, the cushion arrangement is designed so that a straight line extending between a first end of the first longitudinally extending lateral edge surface at the first main side of the cushion arrangement and a first end of the second longitudinally extending lateral edge surface at the first main side of the cushion arrangement has an angle in the interval of 2°-10° relative to a straight line extending between a second end of the first longitudinally extending lateral edge surface at the second main side of the cushion arrangement and a second end of the second longitudinally extending lateral edge surface at the second main side of the cushion arrangement.

According to an alternative to the last-mentioned embodiment, the seat cushion arrangement is arranged so that the second longitudinally extending lateral edge surface of the seat cushion arrangement is arranged adjacent the second longitudinally extending lateral end of the platform in the first operative state and adjacent the first longitudinally extending lateral end of the platform in the second operative state.

In other words, the seat cushion arrangement may be turned 180 degrees and flipped upside down in the second orientation (corresponding to the second operative state; lying configuration) relative to the first orientation (corresponding to the first operative state; sitting configuration). Thus, a first main surface of the seat cushion arrangement may face upwards in the first operative state and a second main surface on an opposite side of the seat cushion arrangement relative to the first main surface may face upwards in the second operative state.

According to a further embodiment, the frame structure is designed so that the first longitudinally extending lateral end of the platform is at a shorter distance from a lower end of the frame structure than a second longitudinally extending lateral end of the platform.

According to one example, the frame structure is designed so that a straight line extending between the first longitudinally extending lateral end of the platform and the second longitudinally extending lateral end of the platform has an angle relative to a horizontal plane, which is larger than zero.

According to a further development of the last-mentioned embodiment, the frame structure is designed so that a straight line extending between the first longitudinally extending lateral end of the platform and the second longitudinally extending lateral end of the platform has an angle in the interval of 1°-20° relative to a horizontal plane.

According to an alternative to the further development of the last-mentioned embodiment, the frame structure is designed so that a straight line extending between the first longitudinally extending lateral end of the platform and the second longitudinally extending lateral end of the platform has an angle in the interval of 2°-10° relative to a horizontal plane.

According to a further embodiment, the platform is arranged in the same orientation irrespective of the seat cushion arrangement being arranged in the first operative state or in the second operative state. According to one example, the platform is fixed relative to the frame structure.

According to a further embodiment, the furniture comprises an upright support section adjacent the first longitudinally extending lateral end of the elongated platform, which forms a backrest in the first operative state.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS

Figure 1:
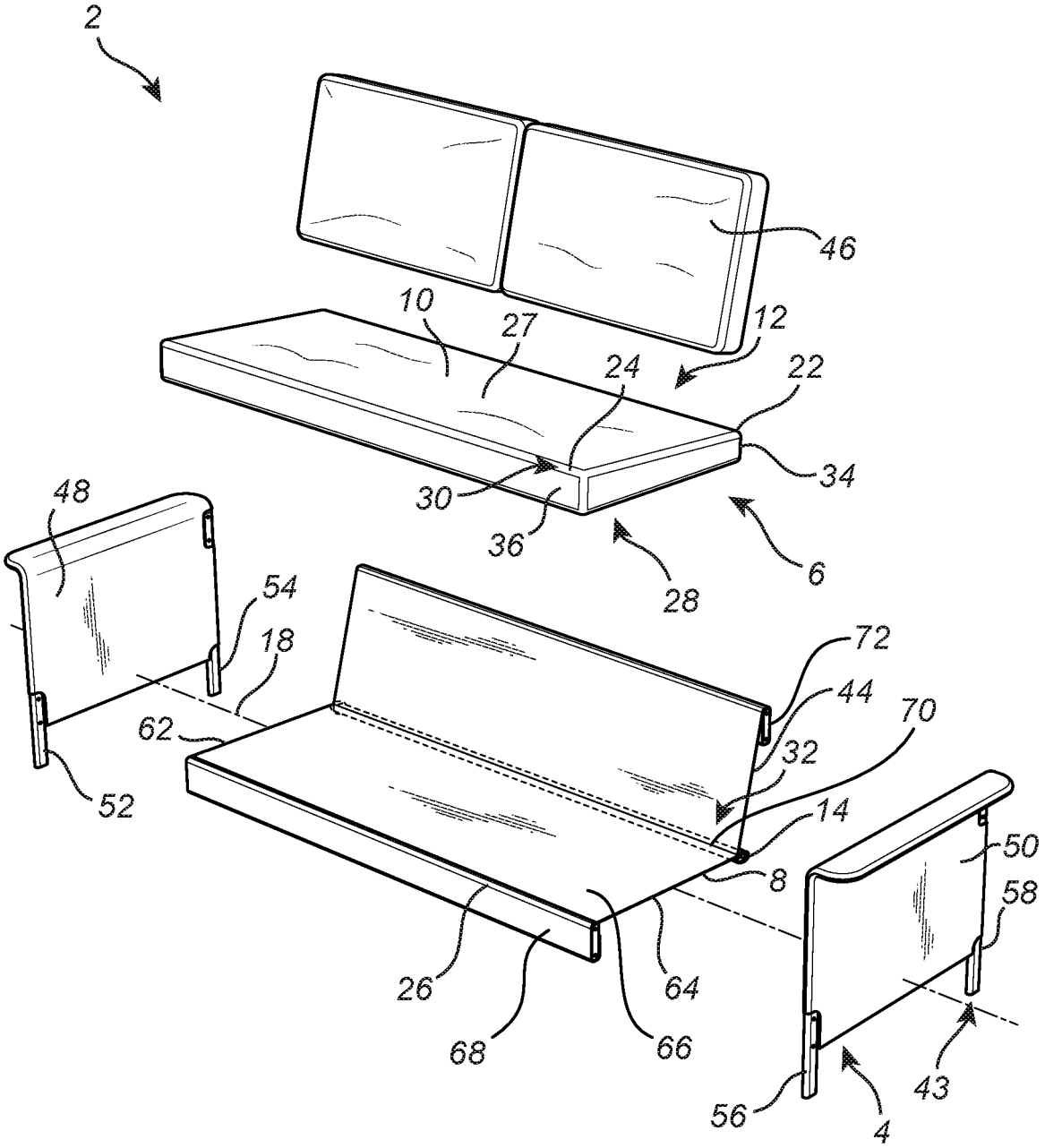
FIG. 1 is a perspective exploded view of a furniture according to one embodiment.

FIG. 1 is a perspective exploded view of a furniture 2 in the form of a sofa according to one embodiment.

The furniture 2 comprises a frame structure 4. The frame structure 4 in turn comprises an elongated platform 8. The elongated platform 8 has a rectangular shape and is adapted to receive a seat cushion arrangement 6. The platform 8 comprises a load-carrying fabric 66, which is attached to and extends between a front beam 68 and rear beam 70. The front beam 68 and rear beam 70 are arranged in parallel with each other and at a distance from each other and define an extension of the platform in a direction perpendicular to a longitudinal direction of the elongated platform. The platform is adapted for absorbing most of the stress and weight on the sofa.

The frame structure 4 further comprises an upright support section 44 forming a backrest. The upright support section 44 is also elongated and extends in a longitudinal direction 18 of the elongated platform 8. The upright support section 44 also has a rectangular shape and is adapted to support a backrest seat cushion arrangement 46. The upright support section 44 comprises a portion of the load-carrying fabric 66. More specifically, the load-carrying fabric 66 is attached to an upper beam 72 and extends between the rear beam 70 of the platform and the upper beam 72. Thus, the load-carrying fabric 66 extends in one piece between the front beam 68 and the upper beam 72 via a change of direction at the rear beam 70.

The frame structure 4 further comprises a structural upright portion defining an armrest 48, 50 on each side of the platform 8 in its longitudinal direction. The armrests 48, 50 are rigidly attached to the platform 8 via attachment means, such as screws. More specifically, each one of the front beam 68 and the rear beam 70 is attached at opposite ends to the armrests 48, 50. In a similar manner, the upper beam 72 is attached at opposite ends to the armrests 48, 50 via attachment means, such as screws.

The frame structure 4 further comprises four legs 52, 54, 56, 58, one at each corner of the elongated rectangular platform 8 for positioning the platform at a vertical distance from a floor. In the shown embodiment, a first pair of legs 52, 54 is formed in one piece with a first one of the armrests 48 and a second pair of legs 56,58 is formed in one piece with a second one of the armrests 50.

The elongated platform 8 defines a generally flat upper surface extending between two longitudinally extending lateral ends 14, 26 and between the two laterally extending longitudinal ends 62, 64.

The furniture 2 further comprises the seat cushion arrangement 6 and the backrest seat cushion arrangement 46. The seat cushion arrangement 6 has a rectangular shape and is adapted to have substantially the same shape and size as the platform 8 for completely covering the platform 8. The seat cushion arrangement 6 is formed in a single cushion piece. Likewise, the backrest seat cushion arrangement 46 has a rectangular shape and is adapted to have substantially the same shape and size as the upright support section 44 for completely covering the upright support section 44. The backrest seat cushion arrangement 46 comprises two rectangular cushion pieces arranged next to each other.

Figure 2A:
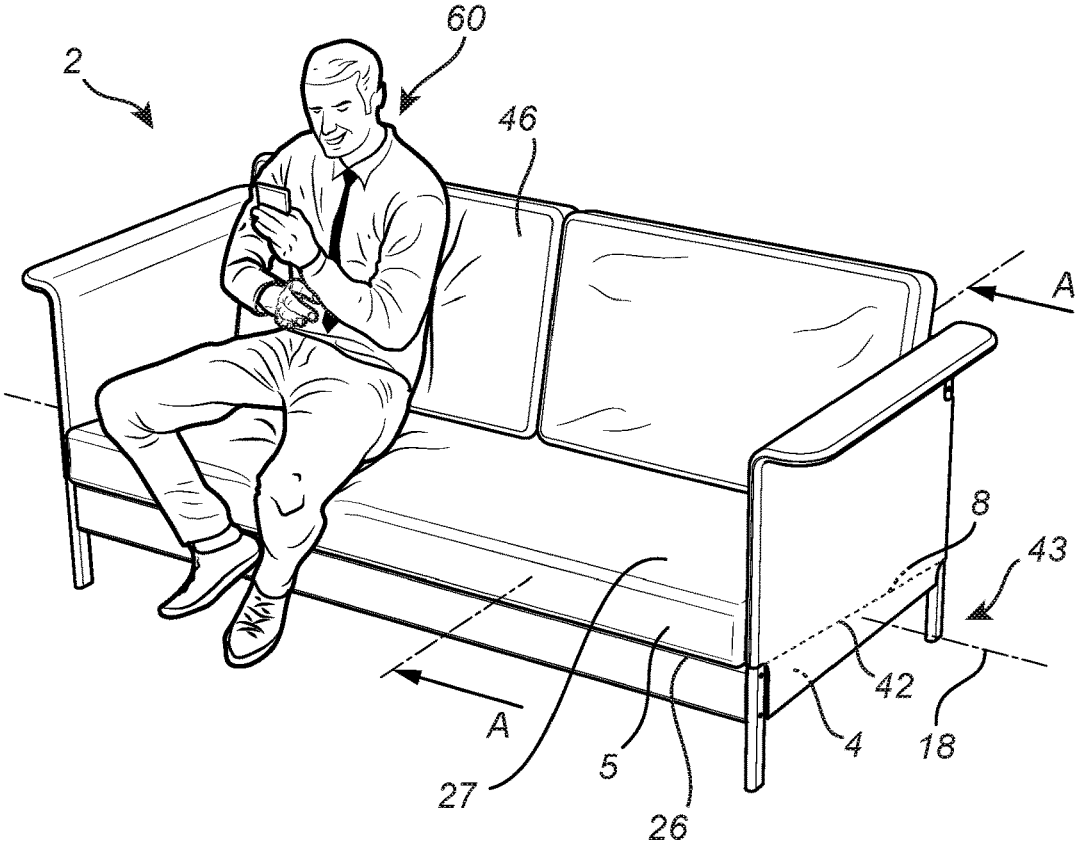
FIG. 2A is a perspective view of the furniture according to FIG. 1 in a perspective view in a first operative state for establishing an elongated sitting area for a plurality of users.
Figure 2B:
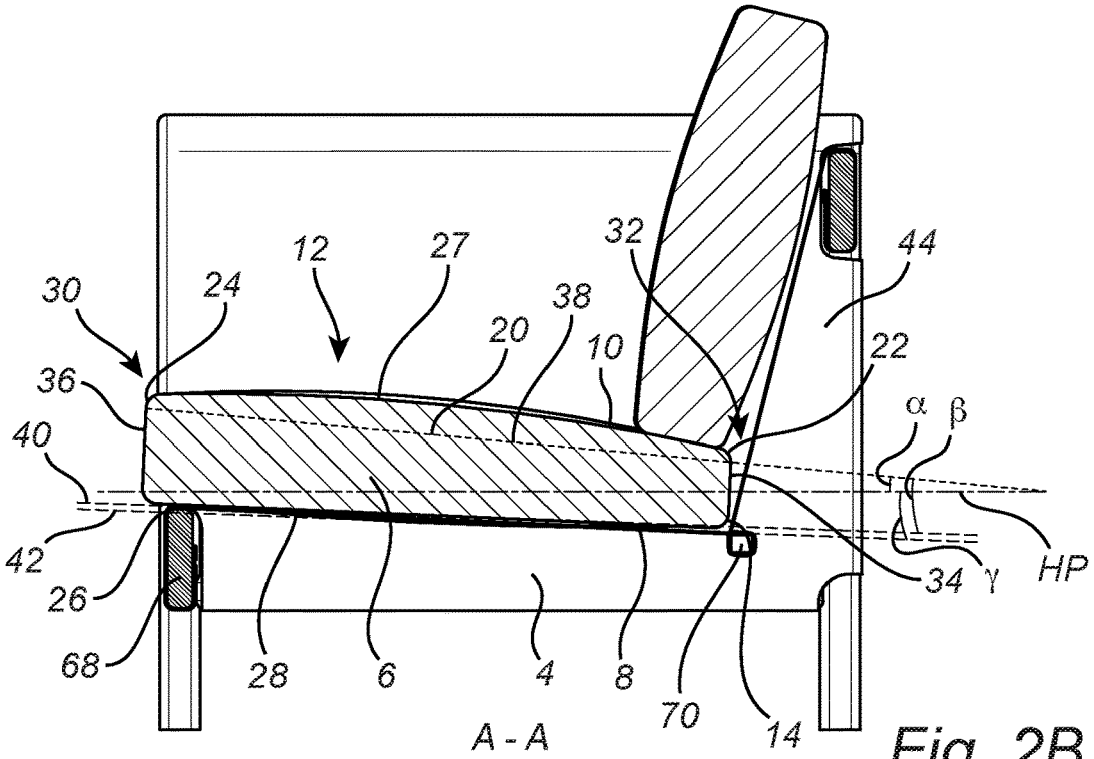
FIG. 2B is a cross section view in the cut A-A of the furniture according to FIG. 2A.

FIG. 2A is a perspective view of the furniture 2 according to FIG. 1 in a perspective view in a first operative state for establishing an elongated sitting area for a plurality of users 60 and FIG. 2B is a cross section view of the furniture 2 according to FIG. 2A.

The platform 8 and the seat cushion arrangement 6 are adapted so that the seat cushion arrangement 6 may be supported by the platform 8 in a first operative state in which at least a substantial portion 10 of an elongated upper surface 12 of the seat cushion arrangement adjacent the first longitudinally extending lateral end 14 of the elongated platform 8 is inclined in relation to a horizontal plane HP towards the first longitudinally extending lateral end 14 of the elongated platform. Such an inclination of a back portion of the upper surface 12 of the seat cushion arrangement 6 adjacent the backrest 44 creates conditions for a comfortable sitting body posture.

The front beam 68 and the rear beam 70 are arranged in such a way relative to one another that the load-carrying fabric 66 is inclined rearwards downwards from the front beam 68 towards the rear beam 70. More specially, the front beam 68 and the rear beam 70 are arranged in such a way relative to one another that the load-carrying fabric 66 is arranged at an angle in the interval of 2°-10° relative to the horizontal plane. More specially, the load-carrying fabric 66 extends between an upper surface of the front beam 68 and an upper surface of the rear beam 70. The front beam 68 is arranged so that its upper surface is at a vertically higher position than the upper surface of the rear beam 70.

More specifically, the elongated platform 8 and the seat cushion arrangement 6 are adapted so that a straight line 20 between a first end 22 of the upper surface 12 of the seat cushion arrangement adjacent the first longitudinally extending lateral end 14 of the elongated platform 8 and a second end 24 of the upper surface 12 of the seat cushion arrangement 6 adjacent a second longitudinally extending lateral end 26 of the elongated platform has an angle $\alpha$ in the interval of 1°-30° and preferably in the interval of 2°-15° relative to a horizontal plane HP when the seat cushion arrangement 6 is arranged in the first operative state.

The seat cushion arrangement 6 comprises a first main surface 27 and a second main surface 28 on an opposite side of the seat cushion arrangement relative to the first main surface. The seat cushion arrangement 6 is adapted to be arranged on the platform 8 so that the first main surface 27 forms the upper surface 12 of the seat cushion arrangement in the first operative state.

The first main surface 27 has a convex shape and the second main surface 28 is substantially flat when the seat cushion arrangement rests on the second main surface 28. In other words, the first main surface 27 forms a bulging surface.

Further, the first main surface 27 and the second main surface 28 at least partly converge in a direction from a second longitudinally extending lateral end 30 of the seat cushion arrangement towards a first longitudinally extending lateral end 32 of the seat cushion arrangement. Thus, the seat cushion arrangement 6 is designed so that the first main surface 27 and the second main surface 28 extend in an acute angle relative to one another.

Further, the seat cushion arrangement 6 comprises a first longitudinally extending lateral edge surface 34, which connects the first main surface 27 and the second main surface 28, and a second longitudinally extending lateral edge surface 36, which connects the first main surface 27 and the second main surface 28 on an opposite side of the seat cushion arrangement relative to the first longitudinally extending lateral edge surface. The second longitudinally extending lateral edge surface 36 has a larger extension in a direction between the first main surface 27 and the second main surface 28 than the first longitudinally extending lateral edge surface 34 so that the first main surface 27 and the second main surface 28 at least partly converge in a direction from the second lateral edge surface towards the first lateral edge surface.

Further, the cushion arrangement is designed so that a straight line 38 extending between a first end of the first longitudinally extending lateral edge surface 34 at the first main surface 27 of the cushion arrangement 6 and a first end of the second longitudinally extending lateral edge surface 36 at the first main surface of the cushion arrangement has an angle β in the interval of 1°-20° and preferably in the interval of 2°-10° relative to a straight line 40 extending between a second end of the first longitudinally extending lateral edge surface 34 at the second main side of the cushion arrangement and a second end of the second longitudinally extending lateral edge surface 36 at the second main side of the cushion arrangement.

Figure 3A:
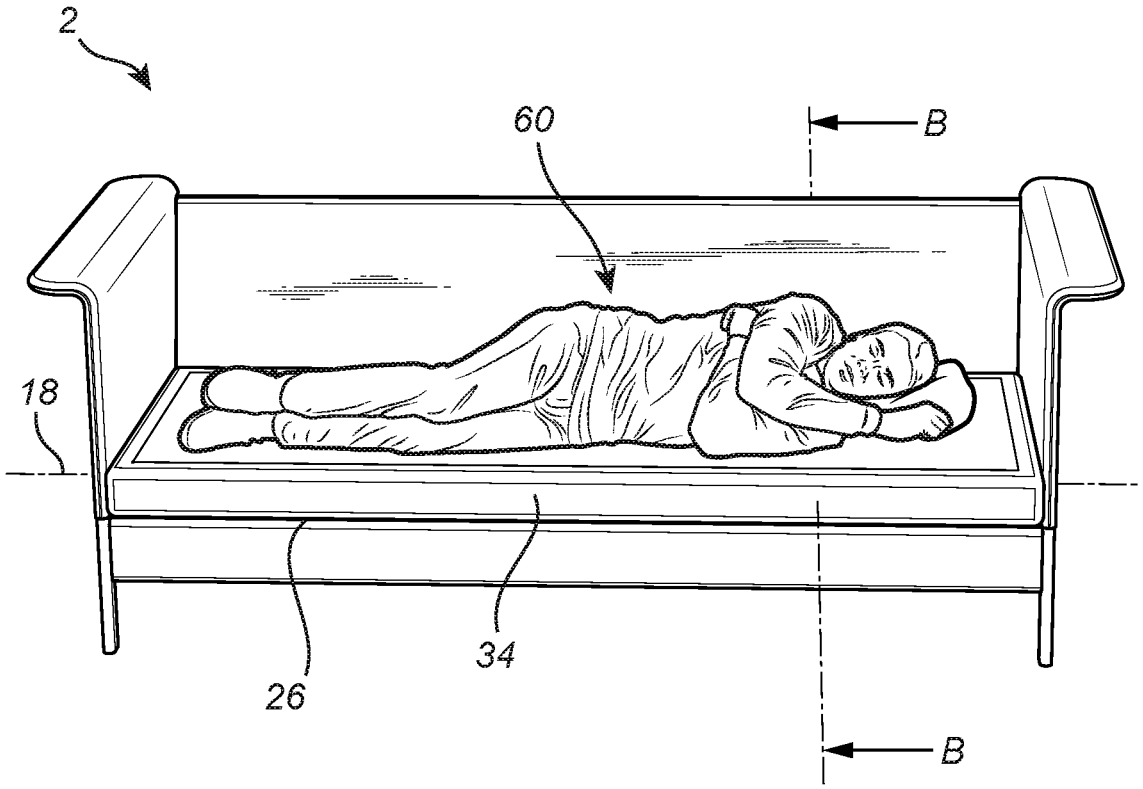
FIG. 3A is a perspective view of the furniture according to FIG. 1 in a perspective view in a second operative state for establishing an elongated lying area for at least one user.
Figure 3B:
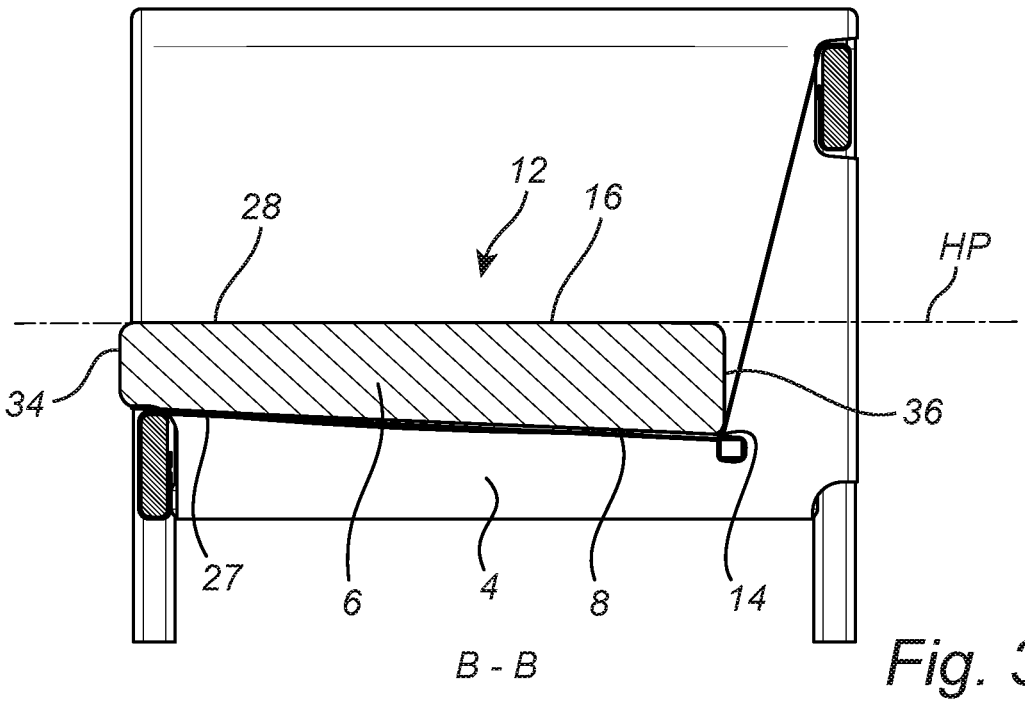
FIG. 3B is a cross section view in the cut B-B of the furniture according to FIG. 3A.

FIG. 3A is a perspective view of the furniture 2 according to FIG. 1 in a perspective view in a second operative state for establishing an elongated lying area for the user 60 and FIG. 3B is a cross section view of the furniture according to FIG. 3A.

The seat cushion arrangement 6 is adapted to be supported by the platform 8 in a second operative state in which a substantial portion 16 of an upper surface of the seat cushion arrangement 6 is in parallel with the horizontal plane HP for establishing an elongated lying area for at least one user, wherein the lying area has a direction between a head end and a foot end in parallel with the longitudinal direction 18 of the platform.

The seat cushion arrangement 6 is adapted to be arranged on the platform 8 so that the second main surface 28 forms the upper surface of the seat cushion arrangement in the second operative state. The first main surface 27 rests against the platform 8. Due to the weight of the user 60, the bulging shape of the first main surface 27 is substantially flattened out.

The seat cushion arrangement 6 is arranged so that the second longitudinally extending lateral edge surface 36 of the seat cushion arrangement is arranged adjacent the second longitudinally extending lateral end 26 of the platform in the first operative state and adjacent the first longitudinally extending lateral end 14 of the platform in the second operative state.

The frame structure is designed so that the first longitudinally extending lateral end 14 of the platform is at a shorter distance from a lower end 43 of the frame structure than a second longitudinally extending lateral end 26 of the platform.

Further, the frame structure is designed so that a straight line 42 extending between the first longitudinally extending lateral end 14 of the platform and the second longitudinally extending lateral end 26 of the platform has an angle γ in the interval of 1°-20° and preferably in the interval of 2°-10° relative to a horizontal plane HP.

The platform 8 is arranged in the same orientation irrespective of the seat cushion arrangement 6 being arranged in the first operative state or in the second operative state.

The elongated platform 8 and the cushion seat arrangement 6 are adapted so that an upper surface 12 of the cushion arrangement 6 at the second longitudinally extending lateral end 24 is at a higher vertical position than the upper surface 12 of the cushion arrangement at the first longitudinally extending lateral end 22 of the cushion arrangement when the cushion arrangement is arranged in the first operative state.

Further, the elongated platform 8 and the cushion seat arrangement 6 are adapted so that an upper surface 12 of the cushion arrangement at the second longitudinally extending lateral end 24 is at substantially the same vertical position as the upper surface 12 of the cushion arrangement at the first longitudinally extending lateral end 22 of the cushion arrangement when the cushion arrangement is arranged in the second operative state.

It is to be understood that the present invention is not limited to the embodiments described above and illustrated in the drawings; rather, the skilled person will recognize that many changes and modifications may be made within the scope of the appended claims.

According to an alternative design, the platform and/or the backrest may be formed in other ways than via a load-carrying fabric. For example, the platform and/or the backrest may be formed by a board of some kind, such as a flat wood-based panel. Such a wood-based panel may be made of a mass of wooden particles, commonly referred to as a chipboard.

According to a further alternative design, the seat cushion arrangement 6 may be designed so that both the first main surface and the second main surface are flat in a non-stressed state.

The invention claimed is:

1. A furniture comprising:

a frame structure; and a seat cushion arrangement;

wherein the frame structure includes an elongated platform;

wherein the elongated platform and the seat cushion arrangement are adapted so that the seat cushion arrangement is supportable by the elongated platform in a first operative state in which at least a substantial portion of an elongated upper surface of the seat cushion arrangement adjacent a first longitudinally extending lateral end of the elongated platform is inclined in relation to a horizontal plane (HP) towards the first longitudinally extending lateral end of the elongated platform to establish an elongated sitting area for a plurality of users;

wherein the seat cushion arrangement is adapted to be supported by the elongated platform in a second operative state in which a substantial portion of an upper surface of the seat cushion arrangement is in parallel with the horizontal plane (HP) to establish an elongated lying area for at least one user;

wherein the lying area has a direction between a head end and a foot end that is parallel to a longitudinal direction of the elongated platform;

wherein the elongated platform is fixed relative to the frame structure, such that the elongated platform is in a same orientation relative to the frame structure in the first and the second operative states.

2. The furniture according to claim 1, wherein the elongated platform and the seat cushion arrangement are adapted so that a straight line between a first end of the upper surface of the seat cushion arrangement adjacent the first longitudinally extending lateral end of the elongated platform and a second end of the upper surface of the seat cushion arrangement adjacent a second longitudinally extending lateral end of the elongated platform has an angle (α) in an interval of 1°-30° relative to the horizontal plane (HP) when the seat cushion arrangement is arranged in the first operative state.

3. The furniture according to claim 1, wherein the elongated platform and the seat cushion arrangement are adapted so that a straight line between a first end of the upper surface of the seat cushion arrangement adjacent the first longitudinally extending lateral end of the elongated platform and a second end of the upper surface of the seat cushion arrangement adjacent a second longitudinally extending lateral end of the elongated platform has an angle (α) in an interval of 2°-15° relative to the horizontal plane (HP) when the seat cushion arrangement is arranged in the first operative state.

4. The furniture according to claim 1, wherein the seat cushion arrangement comprises a first main surface and a second main surface on an opposite side of the seat cushion arrangement relative to the first main surface; and wherein the seat cushion arrangement is adapted to be arranged on the elongated platform so that the first main surface forms the upper surface of the seat cushion arrangement in the first operative state and so that the second main surface forms the upper surface of the seat cushion arrangement in the second operative state.

5. The furniture according to claim 4, wherein the first main surface has a convex shape and the second main surface is substantially flat when the seat cushion arrangement rests on the second main surface.

6. The furniture according to claim 1, wherein the seat cushion arrangement comprises a first main surface and a second main surface on an opposite side of the seat cushion arrangement relative to the first main surface; and wherein the first main surface and the second main surface at least partly converge in a direction from a second longitudinally extending lateral end of the seat cushion arrangement towards a first longitudinally extending lateral end of the seat cushion arrangement.

7. The furniture according to claim 6, wherein the seat cushion arrangement comprises a first longitudinally extending lateral edge surface, which connects the first main surface and the second main surface, and a second longitudinally extending lateral edge surface, which connects the first main surface and the second main surface on an opposite side of the seat cushion arrangement relative to the first longitudinally extending lateral edge surface; and wherein the second longitudinally extending lateral edge surface has a larger extension in a direction between the first main surface and the second main surface than the first longitudinally extending lateral edge surface so that the first main surface and the second main surface at least partly converge in a direction from the second lateral edge surface towards the first lateral edge surface.

8. The furniture according to claim 7, wherein the seat cushion arrangement is designed so that a straight line extending between a first end of the first longitudinally extending lateral edge surface at the first main surface of the cushion arrangement and a first end of the second longitudinally extending lateral edge surface at the first main surface of the cushion arrangement has an angle (β) in an interval of 1°-20° relative to a straight line extending between a second end of the first longitudinally extending lateral edge surface at the second main side of the seat cushion arrangement and a second end of the second longitudinally extending lateral edge surface at the second main side of the seat cushion arrangement.

9. The furniture according to claim 7, wherein the seat cushion arrangement is designed so that a straight line extending between a first end of the first longitudinally extending lateral edge surface at the first main side of the seat cushion arrangement and a first end of the second longitudinally extending lateral edge surface at the first main side of the seat cushion arrangement has an angle (β) in an interval of 2°-10° relative to a straight line extending between a second end of the first longitudinally extending lateral edge surface at the second main side of the seat cushion arrangement and a second end of the second longitudinally extending lateral edge surface at the second main side of the seat cushion arrangement.

10. The furniture according to claim 7, wherein the seat cushion arrangement is arranged so that the second longitudinally extending lateral edge surface of the seat cushion arrangement is arranged adjacent a second longitudinally extending lateral end of the elongated platform in the first operative state and adjacent the first longitudinally extending lateral end of the elongated platform in the second operative state.

11. The furniture according to claim 1, wherein the frame structure is designed so that the first longitudinally extending lateral end of the elongated platform is at a shorter distance from a lower end of the frame structure than a second longitudinally extending lateral end of the elongated platform.

12. The furniture according to claim 11, wherein the frame structure is designed so that a straight line extending between the first longitudinally extending lateral end of the elongated platform and the second longitudinally extending lateral end of the elongated platform has an angle (γ) in an interval of 1°-20° relative to the horizontal plane (HP).

13. The furniture according to claim 11, wherein the frame structure is designed so that a straight line extending between the first longitudinally extending lateral end of the platform and the second longitudinally extending lateral end of the platform has an angle (γ) in an interval of 2°-10° relative to the horizontal plane (HP).

14. The furniture according to claim 1, wherein the elongated platform is arranged in the same orientation irrespective of the seat cushion arrangement being arranged in the first operative state or in the second operative state.

15. The furniture according to claim 1, wherein the furniture comprises an upright support section adjacent the first longitudinally extending lateral end of the elongated platform, which forms a backrest in the first operative state.

16. A furniture comprising:

a frame structure; and a seat cushion arrangement;

wherein the frame structure includes an elongated platform;

wherein the elongated platform and the seat cushion arrangement are adapted so that the seat cushion arrangement is supportable by the elongated platform in a first operative state in which at least a substantial portion of an elongated upper surface of the seat cushion arrangement adjacent a first longitudinally extending lateral end of the elongated platform is inclined in relation to a horizontal plane (HP) towards the first longitudinally extending lateral end of the elongated platform to establish an elongated sitting area for a plurality of users;

wherein the seat cushion arrangement is adapted to be supported by the elongated platform in a second operative state in which a substantial portion of an upper surface of the seat cushion arrangement is in parallel with the horizontal plane (HP) to establish an elongated lying area for at least one user;

wherein the lying area has a direction between a head end and a foot end that is parallel to a longitudinal direction of the elongated platform;

wherein the elongated platform is fixed in all directions relative to the frame structure.

* * * * *